US005255697A

United States Patent [19]

Grauer

[11] Patent Number: 5,255,697

[45] Date of Patent: Oct. 26, 1993

[54] WALKING SUPPORT APPARATUS

[75] Inventor: William K. Grauer, Media, Pa.

[73] Assignee: Working Inc., Media, Pa.

[21] Appl. No.: 781,415

[22] Filed: Oct. 23, 1991

[51] Int. Cl.[5] ..... A61H 3/00

[52] U.S. Cl. ..... 135/67; 135/74; 297/5; 482/66; 280/304.1

[58] Field of Search ..... 135/65, 67, 73, 74; 482/66, 68, 69; 297/5-7; 280/304.1

[56] References Cited

U.S. PATENT DOCUMENTS

| | | | |
|---|---|---|---|
| 188,185 | 3/1877 | Fredrick | 280/7.1 |
| 676,634 | 6/1901 | Sloan et al. | 280/7.1 |
| 2,362,466 | 11/1944 | Carter | 135/67 X |
| 2,960,148 | 11/1960 | Murcott | 155/22 |
| 3,778,052 | 12/1973 | Andow et al. | 272/70.4 |
| 4,037,765 | 7/1977 | Slayman | 224/25 R |
| 4,187,869 | 2/1980 | Marchetti | 135/67 |
| 4,342,465 | 8/1982 | Stillings | 280/87.02 |
| 4,451,471 | 7/1984 | Brastow | 270/70.3 |
| 4,481,965 | 11/1984 | Watkins | 135/67 |
| 4,532,948 | 8/1985 | Burrows | 135/67 |
| 4,941,497 | 7/1990 | Prather et al. | 135/67 |
| 5,112,044 | 5/1992 | Dubats | 482/68 |

*Primary Examiner*—Carl D. Friedman
*Assistant Examiner*—Lan M. Mai
*Attorney, Agent, or Firm*—Jack D. Puffer

[57] ABSTRACT

A walking support device is provided which allows the user to be placed in the device without lifting and is fully adjustable to provide partial or full sitting support for the user. Additionally, the device may be partially dissembled by hand and be folded to a compact size for easy transportability.

21 Claims, 4 Drawing Sheets

WALKING SUPPORT APPARATUS

This invention relates in general to walking support apparatus and in particular such a walker for persons having little control of limb movements or poor coordination of their limbs.

In prior designs for such people, it was usually required that they be lifted into the device and constrained and either placed in an upright walking position or placed upon a seat in the device. These devices are difficult to transport and have little flexibility for the user. It would, therefore, be desirable to provide a walker support apparatus in which the user may be placed in the device easily, may be supported partially or wholly by a seat mechanism and be foldable for easy transportation.

SUMMARY OF THE INVENTION

A walking support apparatus is provided which, by means of minimal disassembly allows the user to be placed in the device without lifting. The user can then be supported by seat means which is adjustable to provide minimal support or total support at the user's option. The device is provided with a low center of gravity for lateral stability and, with minimal disassembly, may be folded into a compact shape for easy transport.

DETAILED DESCRIPTION OF THE PREFERRED EMBODIMENT

Figure 1:
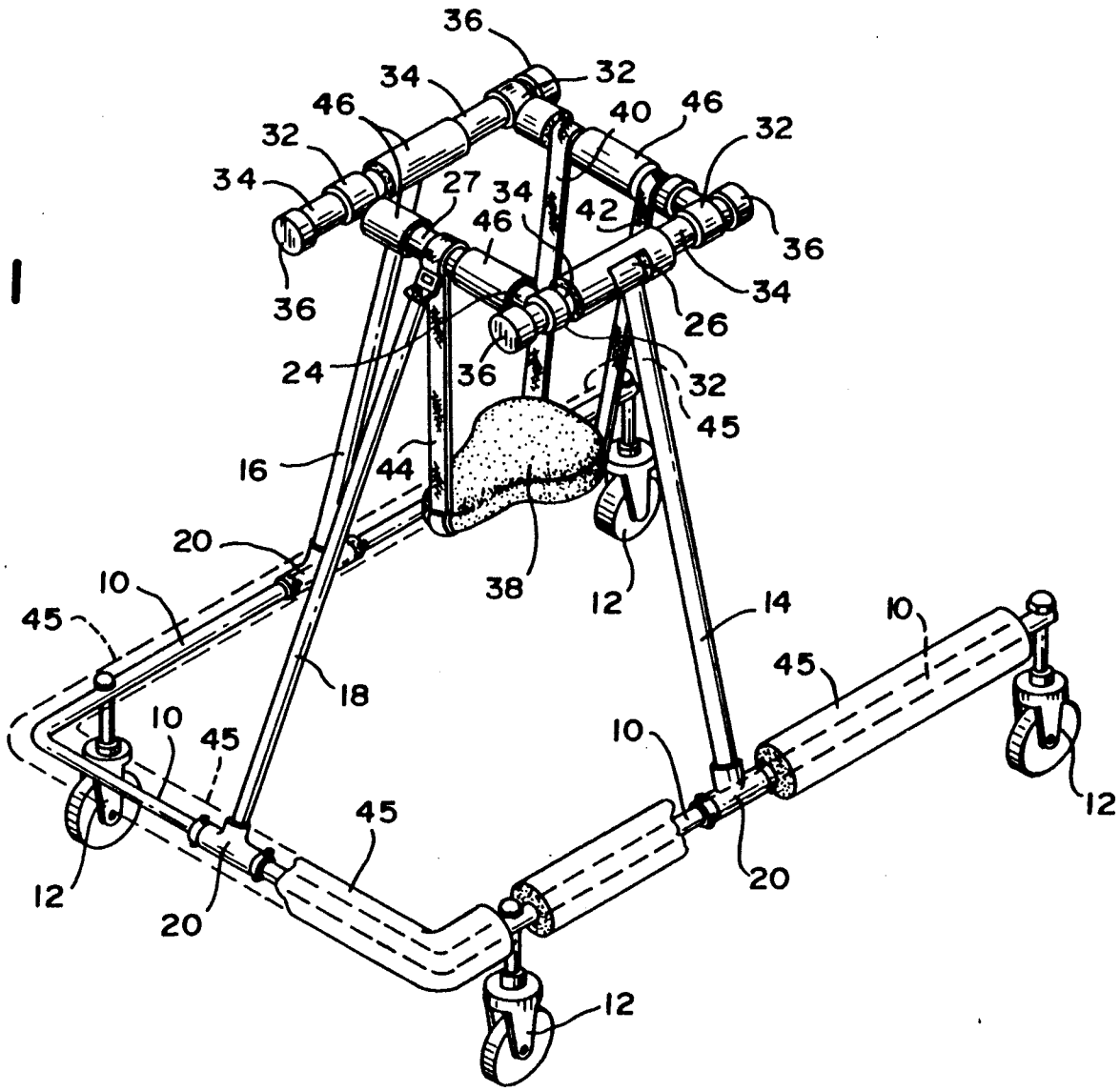
FIG. 1 is isometric view of the assembled walker support apparatus.
Figure 2:
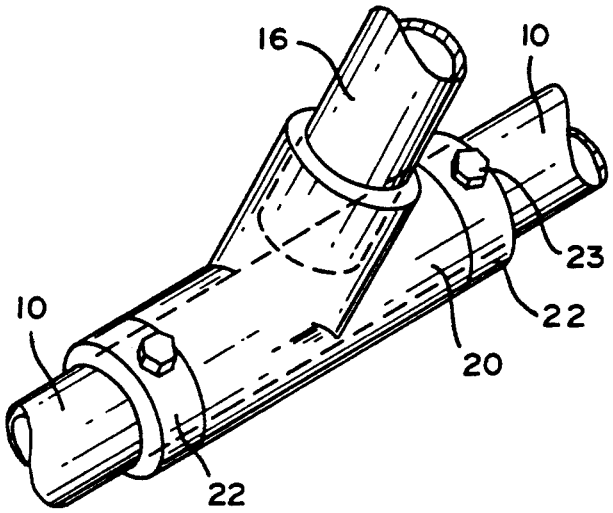
FIG. 2 is a detailed assembly of the vertical support attachment means.

FIG. 1 shows an isometric view of the assembled walker support. The lower frame member 10 is formed of a single piece of tubing material to form a U shape member being open at the rear end. This member is typically fabricated from 1 inch black steel pipe in order to form a heavy base for ensuring a low center of gravity of the device and is covered with a protective padding 45. Attached at each corner of the lower frame member are casters 12 of any well known type. Three vertical support means 14, 16 and 18 are provided to support the upper frame 25. These vertical support members are attached to the lower frame member 10 by means of attachment 20. This T shape member 20 is rotatably supported on the frame 10. It is maintained in place along the frame member 10 by collars 22 secured to the frame by set screws 23 as shown in detail in FIG. 2. The rotatable attachment of these members will be described in further detail in connection with the folding feature of the device.

Figure 3:
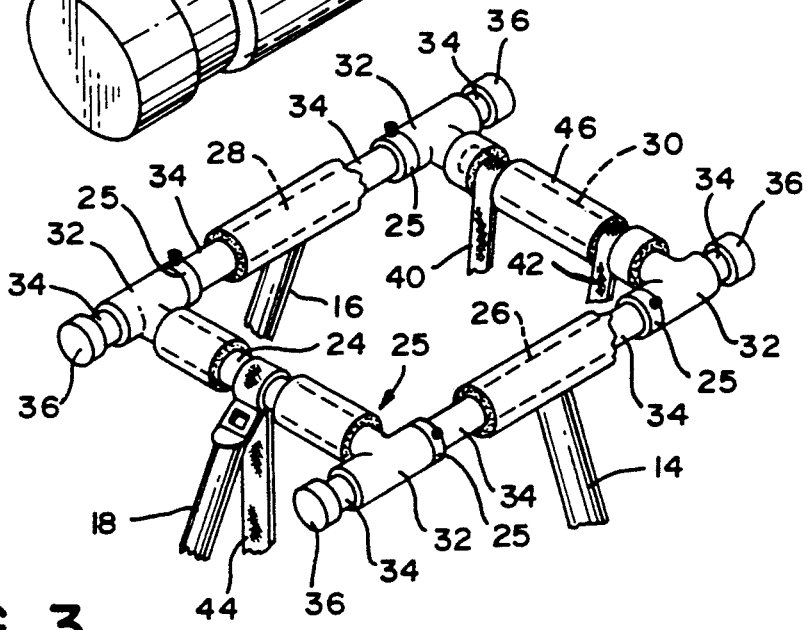
FIG. 3 is an exploded view showing the means of disassembly for folding.

Referring now to FIG. 3, the upper frame member is composed of a forward bar 24, lateral bars 34 and a rear bar 30. The forward, rear and lateral bars are covered with a protective padding 46. The front, lateral and rear bars are all attached to each other by means of attachment assembly 32. The upper frame member is supported by the vertical members and attached by means of T shaped attachment means 26, 27 and 28. These members are rigidly attached to the frame members to prevent rotation between the vertical support means and the upper frame member. The seat member 38 is attached to the upper frame by means of straps 40, 42 and 44. These straps are adjustable by any of several well known means. By this means the seat may be adjustable in accordance with the height of the user or to provide minimal or total support of the user in the device.

Figure 4:
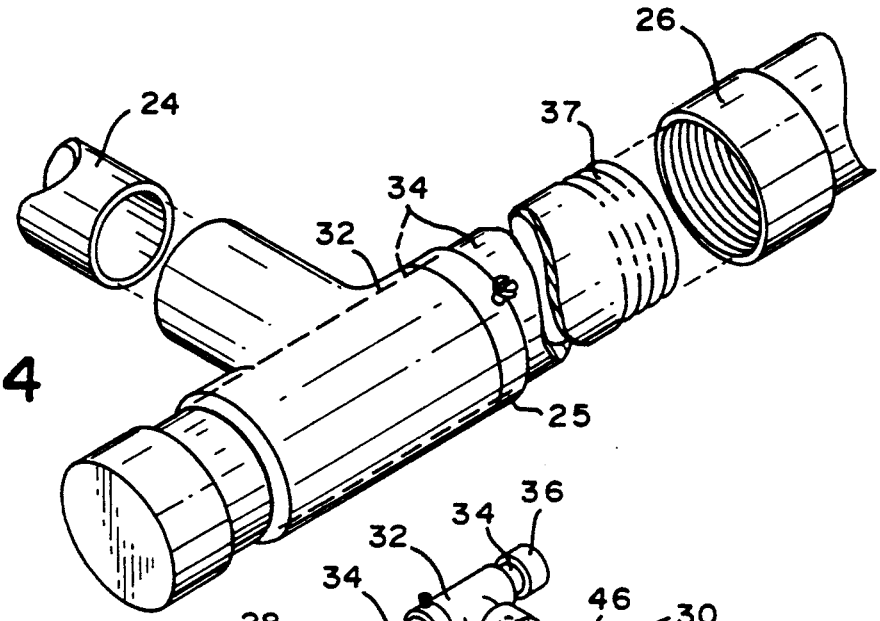
FIG. 4 is an exploded view of the upper frame assembly.

Referring now to FIG. 4, there is shown a detail exploded view of the means of assembling the upper frame member. The T shape member 32 is firmly attached to the front member 24. A lateral support means 34 is slidably inserted in the long arm of the T 32 and retained by fixed collar 29. This member is freely rotatable within member 32. A cap 36 is provided at the end of the lateral support. Member 34 is support means 26 by means of threads 37. This assembly is typical of all four corners of the device.

In using the device, the procedures are as follows. First, the front strap member 44 is detached from the upper frame member and the seat is allowed to drop freely and be suspended by straps 40 and 42. Next, lateral support member 34 at the rear of the upper frame is unscrewed from the support member 26 and the rear upper frame member 30 is allowed to pivot downwardly to open the rear of the upper frame. With the lower and upper frame members opened at the rear, the user may be walked into the upper and lower frame without lifting. Next, the seat support strap 44 may be reattached after bringing the seat under the user. The seat is then adjusted to the appropriate height for the user. Next, the rear member of the upper support frame 30 is reattached by screwing lateral support means 34 into vertical support 26. Thus, the user is firmly encircled by the device and provided sitting means as required and may then proceed to propel the device on his caster wheels.

Figure 6:
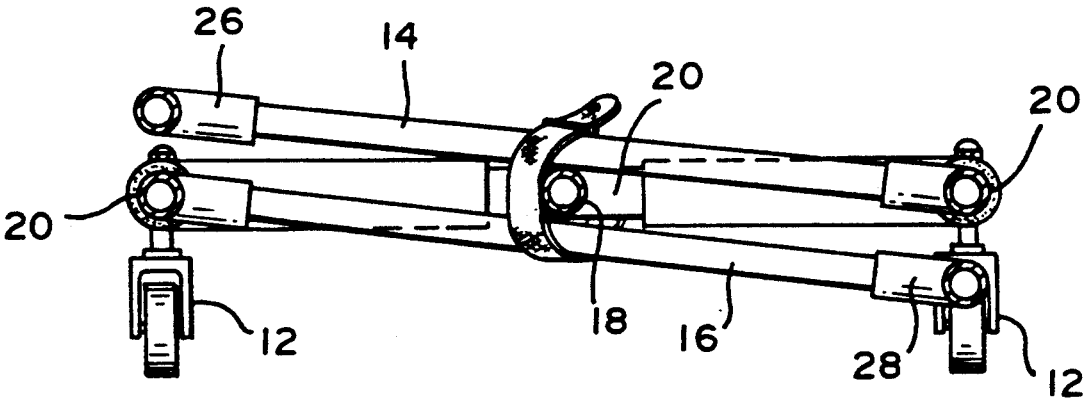
FIG. 6 is an elevation view of the device in its folded state.

In order to make the device easily portable, it has been provided with means to fold the vertical members into a compact, easily transportable package as shown in FIG. 6. In order to accomplish this folding feature, the upper frame member is disassembled at each corner as ,shown in FIG. 3 in the reverse procedure defined above. The vertical support members 14, 16 and 18 may now be rotated on frame member 10 to members 14, 16 and 18 may now be rotated on frame member 10 to a substantially horizontal position as shown in FIG. 6. This partial disassembling and folding can be accomplished without the use of any special tools. The threaded members of the upper frame are engaged to be finger tight and easily removed for folding.

Figure 5:
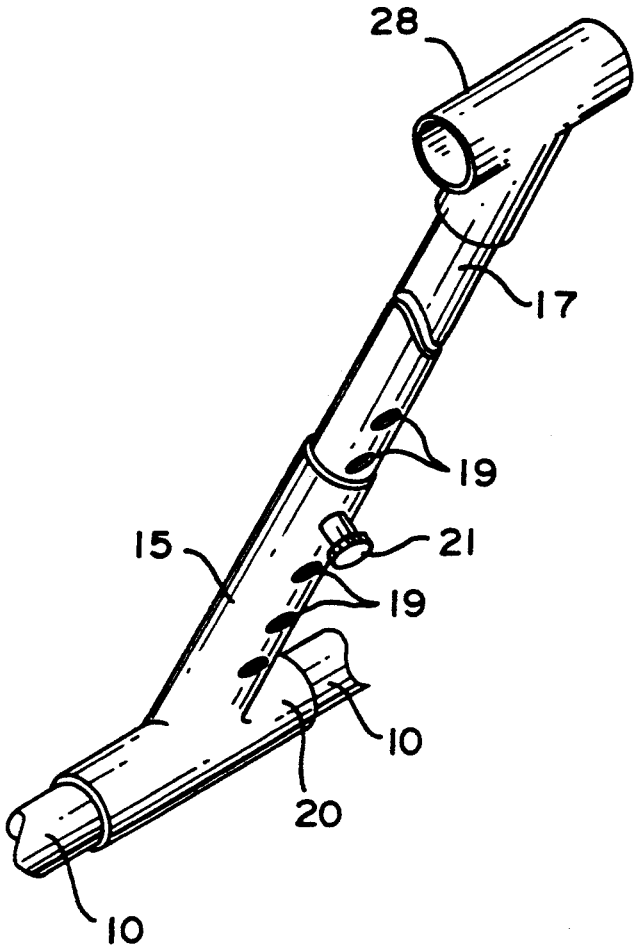
FIG. 5 is an alternate design for the vertical support means which is adjustable for users of different height.

In order to make the device more versatile for users of different sizes, the side support members 14, 16 and 18 may be replaced by adjustable side members, an example of which is shown in FIG. 5. In FIG. 5, the vertical support member is divided into two sections, a lower section 15 and an upper section 17. The lower section 15 is formed of larger diameter pipe than that of 17, such that member 17 may slide within the lower member 15. The series of holes 19 are provided in both 15 the upper and lower members. When the device is set at the proper height, a pin or bolt 21 may be inserted to secure the support at the desire height.

Figure 7:
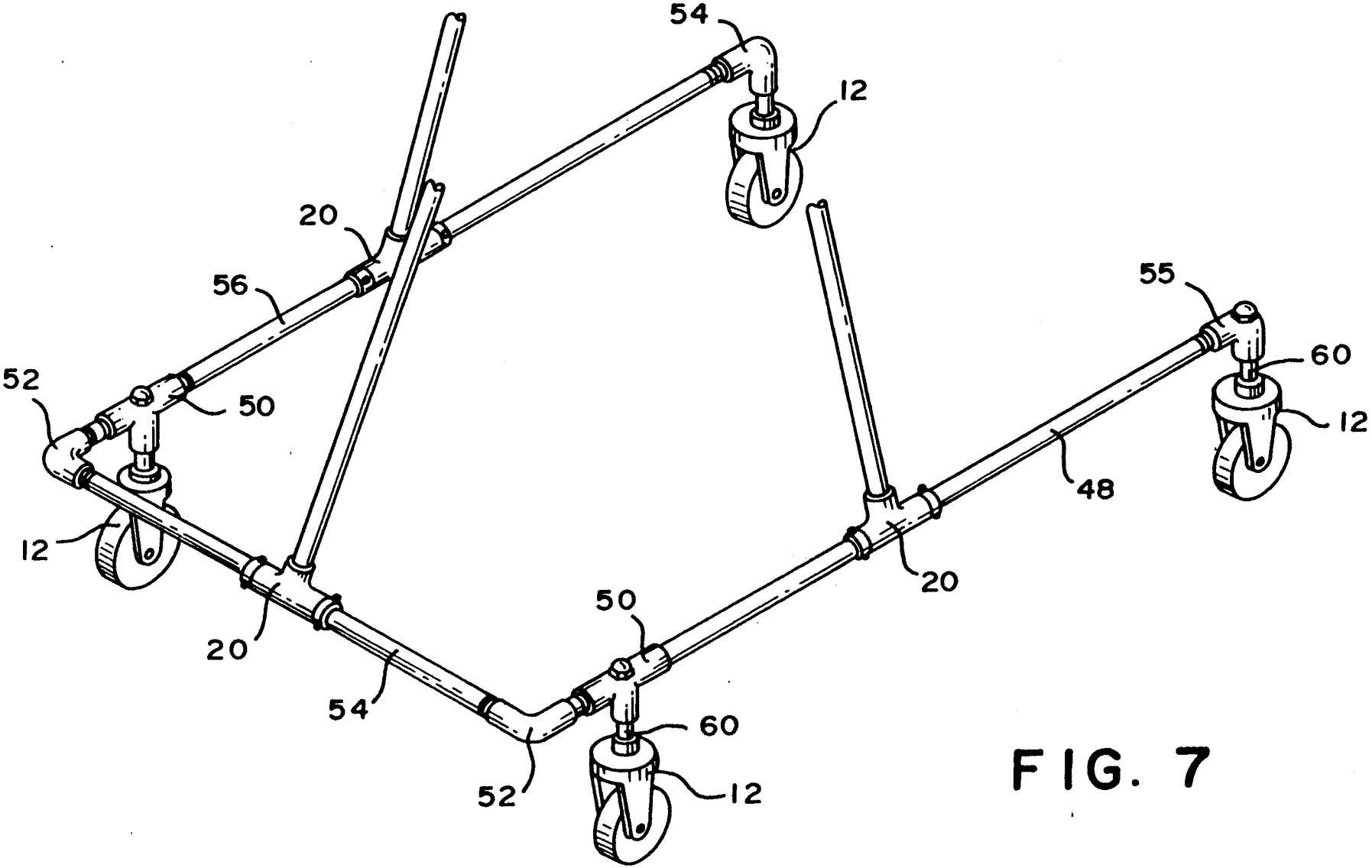
FIG. 7 is an alternate method of fabricating the basic support member.

FIG. 7 shows an alternate means of forming the lower frame members 10. In this embodiment, the lower frame is assembled of component parts, typically used in plumbing applications. The lower frame is comprised of lateral members 48 and 56 and forward member 54. At the rear end of each lateral member, an elbow member 55 is attached by a thread means for support of the rear casters 12. The two lateral members 48 and 56 are connected to forward member 54 by means manner. A short pipe member 60 is threaded into the casters and the T fitting 50 and the elbows 52,54 and 55. This pipe 60 may be varied in length to adjust the total height of the device The vertical support attachment means 20 are assembled in the same manner as described in connection with the preferred embodiment above. By this means, the entire device may be assembled from readily available materials.

Thus, it can be seen from the above description that an easily manufactured walking support device may be provided for adult or children who may be easily introduced into the device without lifting. The device is totally adjustable to provide the amount of sitting support required by the user. In addition, an embodiment is provided for adjustable vertical support members to adjust the height of the device.

What is claimed is:

1. A walking support apparatus for at least partially supporting a user comprising:

a lower frame of a generally U shape having an open end and a closed end and formed by first and second lateral members and a front member, said open end being at the rear of said frame and the closed end being at the front of said frame;

three vertical support members, each having an upper and a lower end, one of said vertical support members being attached at said lower end to each of said lateral members and to the front member of said frame;

an upper frame attached to the upper ends of said vertical support members, said upper frame comprising first and second lateral members having first and second ends and internal threads at each of said ends thereof and attached to the upper ends of the vertical support members attached to the respective lateral members of said lower frame; a front member attached to the vertical support member attached to the front member of said lower frame and having externally threaded portions extending laterally for engagement with said internal threads of one of said lateral members; a rear member having laterally extending portions with external threads for engagement with said internal threads of one end of each of said lateral members, said rear member being selectively removable to allow the user to enter the enclosed area formed by the assembled upper frame.

2. The apparatus according to claim 1 wherein said front and rear members of said upper frame member each comprises:

a central portion having a T shaped member attached to each end thereof lying in a horizontal plane;

a lateral member rotatably supported in said T member and having external threads thereon for engagement with the internal threads of the lateral members of said upper frame;

a cap member attached to the outer end of said lateral member and having an external diameter greater than the internal diameter of said T member;

a collar attached to the lateral member adjacent the other side of said T member.

3. The apparatus according to claim 2 wherein the vertical support members are adjustable in length.

4. The apparatus according to claim 2 further comprising padding material surrounding at least a portion of said lower and upper frame members.

5. The apparatus according to claim 2 and further comprising:

wheel means for rolling support of the apparatus.

6. The apparatus according to claim 5 where four wheels are provided, one attached to each of the corners of said lower frame.

7. The apparatus according to claim 1 wherein said vertical support members are adjustable in length.

8. The apparatus according to claim 1 further comprising padding material surrounding to at least a portion of said lower and upper frame members.

9. The apparatus according to claim 1 and further comprising:

wheel means attached to said lower frame for rolling support of the apparatus.

10. The apparatus according to claim 1 wherein said vertical support means comprises:

a vertical member;

a T member attached to the lower end of said vertical member, the lateral portion of said T member enclosing a portion of its respective portion of the frame member;

collar means for retaining said vertical member at a preselected place on its respective lower frame portion.

11. The apparatus according to claims 1 wherein said lower frame member comprises:

a front portion having an elbow member at each end thereof facing the rear of the frame member;

first and second lateral portions, one at each side of the frame member and attached to the elbow member of its respective side;

second elbow members attached to the other ends of said lateral portions and extending downward therefrom;

T members attached to each of said lateral portions near the front end thereof wheel support means extending downward from said second elbow members and said T members;

wheels attached to said wheel support means for providing rolling support for said apparatus.

12. A walking support apparatus for at least partially supporting a user comprising:

a lower frame of a generally U shape having an open end and a closed end, said U shape being formed by first and second lateral members and a front member, said open end being at the rear of said frame and the closed end being at the front of said frame;

three vertical support members, each having an upper and a lower end, one of said vertical support members being attached at said lower end to a respective one of said lateral members of said lower frame and one attached at said lower end to the front member of said frame, said vertical support members being attached for rotation on their respective lower frame members;

an upper frame comprising first and second lateral members, a front member and a rear member, said upper frame members forming an enclosed area above said lower frame, said rear upper frame member being selectively removable to allow the user to enter said enclosed area formed by the assembled upper frame;

means for releasably attaching said upper frame to said vertical support members whereby upon removal of said upper frame members from said vertical support members, said vertical support members may be rotated on their respective lower frame members to an approximate horizontal position forming a compact assembly for ease of transport; and wheel means attached to said lower frame for rolling support of said apparatus.

13. The walking support apparatus according to claim 12 wherein said upper frame comprises T shaped members, each of said T shaped members having a stem portion attached to a respective vertical support member and a cross portion extending parallel to a respective lateral member of said upper frame, said first and second lateral upper frame members and said front upper frame member each comprising first and second portions, of each of said first and second portions of said lateral and front upper frame members being releasably attached to one end of one of said cross members of said T shaped members on its respective vertical support member, said rear upper frame member comprising a unitary tube;

upper frame connecting members attached to each end of said front and rear upper frame members, said upper frame connecting member having a T shape with a stem portion and a cross portion, attached to the other end of each of said first and second portions of said front upper frame member and to each end of said rear upper frame member, the cross portion of the upper frame connecting member being a hollow tube of greater internal diameter than the external diameter of the lateral upper frame members, said lateral upper frame members being inserted in the cross portion of said connecting members and slidably moveable therein; cap members releasably tot he each end of said lateral upper frame members, said cap members having a larger diameter than the internal diameter of said connecting members thereby retaining said front and rear upper frame members attached to said lateral members and whereby, upon removal of said cap members, said front and rear upper frame members may be removed from the upper frame assembly by sliding said front and rear upper frame members off the ends of said lateral members thus allowing said vertical support members to be rotated on their respective lateral lower frame members to an approximate horizontal position forming a compact assembly for ease of transportation.

14. The apparatus according to claim 13 wherein said T shaped members are releasably attached to said first and second portions of said lateral upper frame members by means of matching threads on adjoining members, and said cap members are releasably attached to said upper frame lateral members by means of matching threads on adjoining members.

15. The apparatus according to claim 13 wherein said vertical support members are adjustable in length.

16. The apparatus according to claim 13 and further comprising padding material surrounding at least a portion of said upper and lower frames.

17. The apparatus according to claim 13 wherein four wheels are provided, one attached to each of the corners of said lower frame.

18. The apparatus according to claim 12 wherein said vertical support members are adjustable in length.

19. The apparatus according to claim 12 and further comprising padding material surrounding at least a portion of said upper and lower frames.

20. The apparatus according to claim 12 wherein four wheels are provided, one attached to each of the corners of said lower frame.

21. The apparatus according to claim 12 wherein said lower frame comprises:

a front member having an elbow at each end thereof facing the rear of the lower frame;

first and second lateral members, one at each side of the lower frame and attached to the elbow member of a respective side;

second elbow members attached to the other ends of said lateral members and extending downward therefrom;

T shaped members attached to said lateral members near said first elbows, the stem of said T members extending downward from said lateral members;

wheel support means extending downward from said second elbow members and said T members; and wheels attached to each of said wheel support means for providing rolling support for said apparatus.

* * * * *